US005185898A

United States Patent [19]

Johnson

[11] Patent Number: 5,185,898

[45] Date of Patent: Feb. 16, 1993

[54] BOTTLE AND CAN PICKER INCLUDING ROTATABLE FLEXIBLE LOOPS

[76] Inventor: Mark A. Johnson, 16550 County Lind Rd., Newark, Ill. 60541

[21] Appl. No.: 892,217

[22] Filed: Jun. 2, 1992

Related U.S. Application Data

[63] Continuation-in-part of Ser. No. 762,792, Sep. 19, 1991, abandoned, which is a continuation of Ser. No. 662,397, Feb. 27, 1991, abandoned, which is a continuation of Ser. No. 440,154, Nov. 22, 1989, abandoned, which is a continuation-in-part of Ser. No. 374,887, Jul. 3, 1989, abandoned.

[51] Int. Cl.[5] ..... B08B 11/00

[52] U.S. Cl. ..... 15/3; 15/83; 15/90; 15/179; 15/183; 15/92; 56/328.1; 171/53

[58] Field of Search ..... 15/3, 5, 55, 79.1, 79.2, 15/83, 84, 90, 91, 92, 82, 179, 183, 230.16, 366; 56/16.4, 16.6, 202, 29, 52, 40, 294, DIG. 19, 231, 198, 328.1, 329, 63; 171/53, 116

[56] References Cited

U.S. PATENT DOCUMENTS

| | | | |
|---|---|---|---|
| 592,267 | 10/1897 | Wye | 15/91 |
| 664,135 | 12/1900 | Dufour | 15/79.1 |
| 1,894,361 | 1/1933 | Shank | 15/92 |
| 2,505,576 | 4/1950 | Reitan | 56/27 |
| 2,756,978 | 7/1956 | Wachsmith | 56/29 |
| 2,882,667 | 4/1975 | Brady | 56/24 |
| 3,402,542 | 9/1968 | Johnston | 56/29 |
| 3,579,969 | 5/1971 | Richter | 56/328.1 |
| 3,777,327 | 12/1973 | Ellis | 15/84 |
| 3,807,154 | 4/1974 | Moore | 56/328 R |
| 4,214,336 | 7/1980 | Peterson | 15/3 |
| 4,290,820 | 9/1981 | Swisher, Jr. et al. | 134/6 |
| 4,550,465 | 11/1985 | Chrisley | 15/84 |
| 4,593,426 | 6/1986 | Chrisley | 15/84 |
| 4,646,380 | 3/1987 | Kobayashi et al. | 15/230.16 |
| 5,121,592 | 6/1992 | Jertson | 15/79.2 |

FOREIGN PATENT DOCUMENTS 970618 9/1964 United Kingdom .

OTHER PUBLICATIONS

The Daily Times, Ottawa, Ill., Tuesday, Apr. 17, 1990, pp. 1, 8.

*Primary Examiner*—Gary K. Graham

*Attorney, Agent, or Firm*—McAndrews, Held & Malloy, Ltd.

[57] ABSTRACT

A bottle and can picking apparatus includes a portable carrier frame, a rotatable member mounted on the carrier frame, a plurality of flexible loops attached to the rotatable member and extending radially therefrom for picking up the bottles, cans and other litter, a drive motor for driving the rotation of the rotatable member, and a waste receptacle for receiving and holding the litter picked up by the loops. As the carrier frame is moved over the ground and the rotatable member is rotated, the flexible loops come in sweeping contact with the ground, dislodging the litter and lifting it upwardly and rearwardly into the waste receptacle.

24 Claims, 5 Drawing Sheets

BOTTLE AND CAN PCKER INCLUDING ROTATABLE FLEXIBLE LOOPS

This application is a continuation in part of co-pending application Ser. No. 762,792 filed Sep. 19, 1991 now abandoned which is a continuation of Ser. No. 662,397 filed Feb. 27, 1991 now abandoned, which is a continuation of Ser. No. 440,154 filed Nov. 22, 1989 now abandoned, which is a continuation in part of Ser. No. 374,887 filed Jul. 3, 1989 now abandoned.

BACKGROUND OF THE INVENTION

This invention relates to the field of litter collection, and in particular to machines that pick up bottles and cans.

Prior art litter collection machines have been designed to operate in a horizontal plane to clean streets, parks, parking lots and other recreational areas. No litter collection machine has addressed the problem of collecting litter on sloping terrain such as ditches along streets and highways and recreational areas where there is a severe undulating terrain.

The problem with prior art litter collection machines is that the collection apparatus, whether it is rollers or brushes is constrained to a horizontal plane of operation, thereby rendering the machine ineffective for litter pick up in ditches or severe undulating terrain. Another problem with prior art litter collection machines is that they are large with high centers of gravity causing the machine to be unstable on sloping terrain. Another problem with the prior art are the complex and expensive conveyor systems utilized to move litter from the pick-up means to the storage area thereby increasing machine costs.

Another problem with prior art litter pickup machines is that the "fingers" that make contact with the litter to sweep or pick up the litter often fail to engage or retain bottles and cans for subsequent removal. Consequently, some bottles and cans remain on the ground.

Examples of prior art devices include those disclosed in the following U.S. patents:

U.S. Pat. No. 4,593,426 discloses a litter collection machine with retrieval means including a roller with projections to remove surface litter and an adjustable mounting apparatus whereby the retrieval means may be moved toward or away from the surface. One problem with this machine is that the machine is large and has a high center of gravity thereby making it susceptible to "tipping over" when traveling perpendicular to the direction of slope of a hill or ditch. Another problem is that the projections are not efficient in picking up bottles and cans but rather intended to pick up paper and other light trash. Another problem is that the machine utilizes a complex conveyor system to elevate litter to a storage hopper thereby contributing to the machines high center of gravity and an elevated cost of purchase.

U.S. Pat. No. 4,550,465 discloses a litter collection machine with tandem rollers each having ground engaging rows of resilient fingers. The fingers spread apart to entrap litter and mesh between the rollers to transfer litter downstream to a main frame conveyor for containment within a trash drum. A pair of wiper blades remove entrapped litter between the fingers and provide a transfer path for the litter to the trash drum.

U.S. Pat. No. 4,290,820 discloses a front-end loader machine for collecting material on a roadway surface with a rotating brush on each front side touching the roadway surface to sweep material into a scraper blade. The scraper blade moves the collected material to an elevator assembly that elevates the collected material to a rear overhead discharge position for collection in a trailing hopper.

U.S. Pat. No. 4,214,336 discloses a litter collection machine including a self-propelled vehicle having a receiving tank mounted to the vehicle's frame and three spiked rollers attached to the rear end of the vehicle to pick up litter and feed the litter on a conveyor assembly that elevates the litter into an opening in the rear end of the receiving tank.

U.S. Pat. No. 3,807,154 discloses a litter collection system including a single large drum pulled behind a self-propelled vehicle with spring loaded fingers attached to the surface of the drum to engage litter articles. Once the fingers engage the litter, the drum rotates and positions the engaged litter above a collection basket where the litter is disengaged from the fingers by strippers that force the litter into the collection basket.

U.S. Pat. No. 3,777,327 discloses a litter collection machine that is self-propelled with a rotating drum to which flexible flaps are attached to pick up litter and deposit the litter upon a conveyor. The conveyor allows small stone and dirt to drape from the heavier litter, with the heavier litter being transported to a hammer mill and conveying structure that upwardly conveys the heavier litter to an elongated storage bin.

SUMMARY OF THE INVENTION

It is an object of this invention to provide a bottle and can picker that is self-propelled or can be towed behind a separate drive machine.

It is an object of this invention to provide a bottle and can picker that can pick-up bottles and cans in ditches or other severe undulating terrain.

It is an object of this invention to provide a bottle and can picker with a carrier frame to support and house the bottle and can picker equipment.

It is an object of the invention to provide a bottle and can picker that has a plurality of short durable pick-up elements, such as chains or loops connected to a rotatable member to pick-up heavier litter including bottles and cans.

It is an object of this invention to provide a bottle and can picker with pick-up means that is adjustable relative to an undulating terrain.

It is an object of this invention to provide a bottle and can picker which does not require a conveyor system to move litter from the pick-up means to the storage means, but which lifts such items from the ground and tosses them rearwardly a sufficient distance to fall into a storage receptacle or hopper.

It is an object of this invention to provide a bottle and can picker with a low center of gravity to utilize the invention on severe slopes or undulating terrain.

It is an object of the invention to provide a bottle and can picker with a receiving bin to temporarily store collected bottles and cans.

It is an object of this invention to provide a bottle and can picker with drive means to drive the rotatable member at a rotational speed relatively greater than the forward speed of the carrier frame.

DESCRIPTION OF THE PREFERRED EMBODIMENTS

Figure 1:
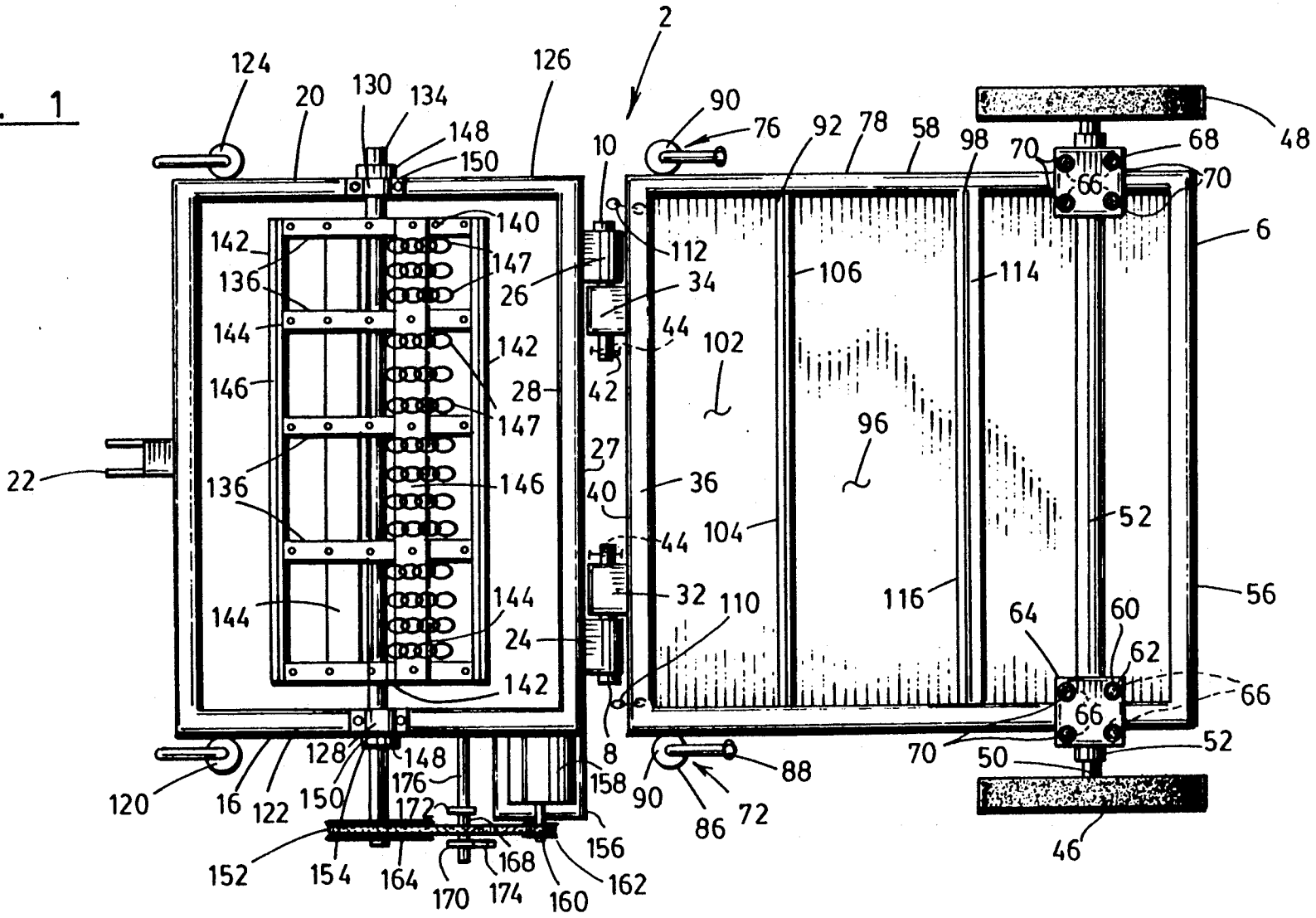
FIG. 1 is a plan view of the bottle and can picker in accordance with this invention.
Figure 3:
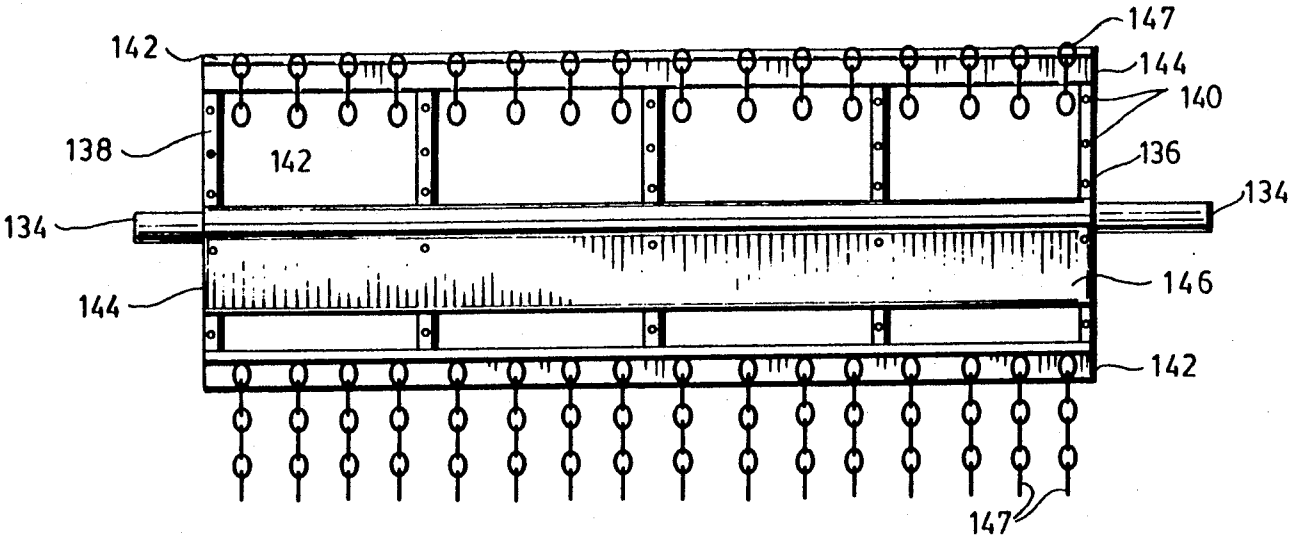
FIG. 3 is a rear elevation view of the reel assembly shown in FIG. 1 and FIG. 2.
Figure 2:
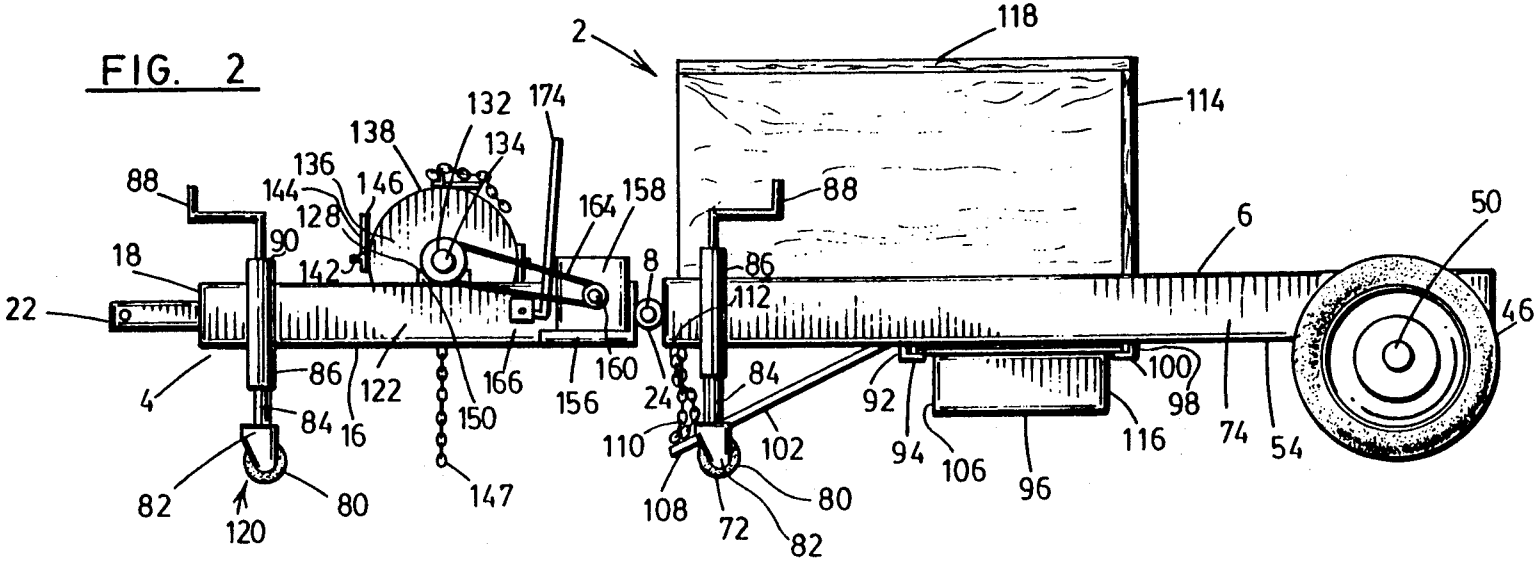
FIG. 2 is a side elevation view of the bottle and can picker shown in FIG. 1.
Figure 4:
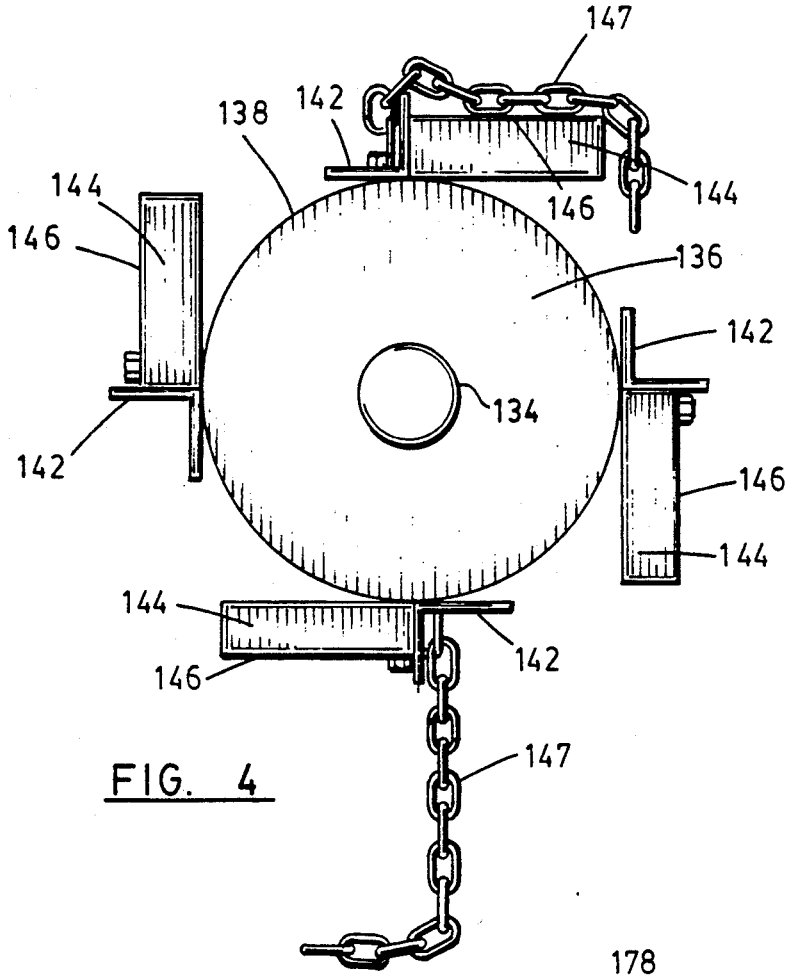
FIG. 4 is a side elevation view of the reel assembly shown in FIG. 1 and FIG. 2.

A bottle and can picker 2 in accordance with the present invention includes a front carrier frame 4 and rear carrier frame 6 connected together with a first hinge pin 8 and a second hinge pin 10 to allow the two frames to operate in different planes.

The front carrier frame 4 is constructed from tubular metal bars that have a rectangular cross-section with a width of two inches and a height of four inches and a wall dimension of one-quarter inch. The front carrier frame 4 has a rectangular configuration with a first side bar 16 having a length of approximately three feet and a front bar 18 having a length of approximately five feet. The rear carrier frame 6 is constructed of the same tubular metal bars as is the front carrier frame 4. The rear carrier frame 6 has a square configuration with each side approximately five feet in length.

The front carrier frame 4 has a pulling hitch 22 welded to the front bar 18 to connect the bottle and can picker 2 to a tractor or other pulling vehicle. A first hinge 24 and second hinge 26 are welded to the outer side surface 27 of the rear bar 28 of the front carrier frame 4.

The first hinge 24 and second hinge 26 are cylindrical, tubular metal pipes with an outer diameter of one inch and a wall dimension of one-quarter inch. The length of the hinges is approximately six inches. The hinges are welded to the outer side 27 of the bar 28 of the front carrier frame 4 such that the longitudinal axes of both hinges are parallel to the rear bar 28 with the axes of the hinges in alignment in a horizontal plane and the hinges being spaced apart a distance of approximately two feet.

The rear carrier frame 6 has a first hinge 32 and second hinge 34 welded to the outer side surface 40 of the front bar 36 of the rear carrier frame. The first hinge 32 and second hinge 34 are cylindrical, tubular metal pipes with an outer dimension of one inch and a wall dimension of one-quarter inch. The length of the hinges is approximately six inches. The hinges are welded to the outer side 40 of front bar 36 such that the longitudinal axes of both hinges are parallel to the front bar 36 with the axes of the hinges in alignment in a horizontal plane and the hinges being spaced apart a distance of on foot to allow the first hinge 32 and second hinge 34 of the rear carrier frame 6 to be placed between the first hinge 24 and second hinge 26 of the front carrier frame 4.

The first hinge pin 8 is inserted through the aligned first hinge 24 of the front carrier frame 4 and the first hinge 32 of the rear carrier frame 6. The second hinge pin 10 is inserted through the aligned second hinge 26 of the front carrier frame 4 and the second hinge 34 of the rear carrier frame 6.

Cotter pins 42 are inserted through small apertures 44 in the hinge pins 8 and 10 to prevent the hinge pins from withdrawing from the hinges.

A first wheel 46 and second wheel 48 each approximately two feet in diameter are connected together by an axle 50 with the axle encased by an axle casing 52. The first side bar 54 of the rear carrier frame 6 is positioned upon the axle casing 52 such that the axle casing 52 is approximately six inches from the rear bar 56. The second side bar 58 of the rear carrier frame 6 is positioned upon the axle casing 52 such that the axle casing 52 is approximately six inches from the rear bar 56.

Two U-bolts 60 with threaded ends 62 are positioned around the axle casing 62 and extend upward with one U-bolt 60 on each side of the first side bar 54 to secure the axle casing position relative to the first side bar. An anchor plate 64 with four apertures 66 is placed on the top surface of the first side bar 54. The apertures 66 are positioned to receive the four threaded ends 62 of the U-bolts 60. The U-bolts 60 are inserted through the anchor plate 64 and secured in place with four washers 68 and four nuts 70.

Two U-bolts 60 with threaded ends 62 are positioned around the axle casing 62 and extend upward with one U-bolt 60 on each side of the second side bar 58 to secure the axle casing position relative to the second side bar. An anchor plate 64 with four apertures 66 is placed on the top surface of the second side bar 58. The apertures 66 are positioned to receive the four threaded ends 62 of the U-bolts 60. The U-bolts 60 are inserted through the anchor plate 64 and secured in place with four washers 68 and four nuts 70.

A third wheel assembly 72 is welded to the outer side surface 74 of the first side bar 54 near the front bar 36 of the rear carrier frame 6. A fourth wheel assembly 76 is welded to the outer side surface 78 of the second side bar 58 near the front bar 36 of the rear carrier frame 6.

The third wheel assembly 72 and the fourth wheel assembly 76 are identical in design with a wheel 80 approximately six inches in diameter and a castor 82 attached to the wheel to allow the wheel 80 to rotate 360 degrees. The castor 82 inserts into a rod 84 extending from a cylinder 86 with a handle 88 mounted to the top surface 90 of the cylinder 86. The handle 88 allows the position of the rod 84 to be adjusted to allow the elevation of the front bar 36 of the rear carrier frame 6 to be set closer to or farther from the ground upon which the litter is being collected.

A first angle iron 92 is welded to the bottom surface of the first side bar 54 and the bottom surface of the second side bar 58 such that the angle iron 92 is perpendicular to both side bars 54 and 58. The first angle iron 92 is placed approximately eighteen inches from the rear bar 56 and oriented such that the lower side 94 of the angle iron 92 forms a "lip" which a litter bin 96 can slide upon. A second angle iron 98 is welded to the bottom surface of the first side bar 54 and the bottom surface of the second side bar 58 such that the angle iron 98 is perpendicular to both side bars 54 and 58. The second angle iron 98 is placed approximately eighteen inches from the front bar 36 and oriented such that the lower side 100 of the second angle iron 98 forms a "lip" which a litter bin 96 can slide upon. The two angle irons 92 and 98 form a groove that allows the litter bin 96 to be inserted quickly and, once filled, easily removed to empty.

The litter bin 96 is approximately two feet wide, five feet long and one foot deep with an outer "lip" traversing the length of the bin 96 to provide support when the bin 96 is inserted between the angle irons 92 and 98.

A metal guiding plate 102, to guide litter into the litter bin 96 has a first longitudinal side 104 positioned above the first longitudinal side 106 of the litter bin 96 closest to the front bar 36. The first longitudinal side 106 of the guiding plate 102 is fastened to the inner side surfaces of the first side bar 54 and second side bar 58. The second longitudinal side 108 of the guiding plate 102 is positioned approximately one inch above grade level. A first support chain 110 is anchored to the bottom side surface of the first side bar 54 and attached to the second longitudinal side 108 of the guiding plate 102. A second support chain 112 is anchored to the bottom side surface of the second side bar 58 and attached to the second longitudinal side 108 of the guiding plate 102.

A strike board 114 is installed vertically above the second longitudinal side 116 of the litter bin 96. The strike board 114 allows litter to hit the board then fall into the litter bin 96. The strike board is made of plywood one inch thick and extends longitudinally from the first side bar 54 to the second side bar 58. The strike board rises vertically approximately three feet and the board 114 is one inch thick. The strike board 114 is held in place by utilizing angle iron to make a frame to which the strike board 114 is connected.

An enclosure board 118 is installed horizontally above the rear carrier frame 6 from the strike board 114 to the front bar 36. The enclosure board 118 acts as a safety cover to keep litter from flying above the strike board 114. The enclosure board is made of plywood one inch thick and extends longitudinally from the first side bar 54 to the second side bar 58. The enclosure board is held in a horizontal plane approximately three feet above the rear carrier frame 6 by utilizing angle iron to make a frame to which the enclosure board 118 is connected.

A fifth wheel assembly 120 is welded to the outer side surface 122 of the first side bar 16 near the front bar 18 of the front carrier frame 4. A sixth wheel assembly 124 is welded to the outer side surface 126 of the second side bar 20 near the front bar 18 of the front carrier frame 4.

The fifth wheel assembly 120 and sixth wheel assembly 124 are identical in design to the third wheel assembly 72 and fourth wheel assembly 76. A wheel 80 approximately six inches in diameter has a castor 82 attached to the wheel to allow the wheel 80 to rotate 360 degrees. The castor 82 inserts into a rod 84 extending from a cylinder 86 with a handle 88 mounted to the top surface 90 of the cylinder 86. The handle 88 allows the position of the rod 84 to be adjusted to allow the elevation of the front bar 18 of the front carrier frame 4 to be set closer to or farther from the ground upon which the litter is being collected. A first bearing assembly 128 is attached to the upper surface of the first side bar 16 of the first carrier frame 4 and positioned approximately eighteen inches form the rear bar 28 of the first carrier frame 4. A second bearing assembly 130 is attached to the upper surface of the second side bar 20 of the first carrier frame 4 and positioned approximately eighteen inches from the rear bar 28 of the first carrier frame 4. The inner raceway 132 of each bearing assembly 128 and 130 are aligned to receive a solid metal cylindrical drive rod 134 and to position the longitudinal axis of the drive rod 134 parallel to the rear bar 28.

Five metal disks 136 one foot in diameter are attached to the cylindrical drive rod 134. The disks 136 are equidistant spaced along the length of the drive rod 134. Each disk has an outer edge 138 approximately one inch wide with a plurality of apertures 140 each approximately one-half inch in diameter and circumferentially spaced apart approximately four inches.

Four angle iron sections 142 are attached to the outer edge 138 of each disk 136. The angle iron section 142 are radially spaced apart 90 degrees with each angle iron parallel to the metal drive rod 134.

One wooden board 144 is attached to each angle iron 142. The boards 144 are equal in length to the angle iron, approximately six inches in width and one inch thick. The board 144 are attached to the angle iron 142 such that the upper surface 146 of the board 144 is tangentially positioned to the outer edge 138 of the disks 136.

A plurality of chains 147 each one-foot long are attached to two of the angle iron 142 positioned 180 degrees apart. The chains 147 can be made of metal although alternative materials such as plastic may be utilized so long as the chains 147 are durable. The chains 147 are spaced apart approximately two and three-quarters inches along the entire length of the two angle irons 142. Each chain 147 is formed by twelve individual links with the bottom link making contact with the ground when the chains 147 are not rotating.

Two hubs 148 are attached to the metal drive rod 134 adjacent to the outer sides 150 of the bearing assemblies 128 and 130 to secure the position of the drive rod 134 and chains 147.

A pulley 152 is attached to the drive rod 134 adjacent to the outer side 154 of the hub 148 next to the first bearing assembly 128. The pulley 152 is approximately eight inches in diameter and utilized to rotate the drive rod 134 that drives the chains 147 outward away from the direction of rotation. The whip action of the rotating chains 147 has enough force to throw litter including bottles and cans up the guiding plate 102 and into the litter bin 96 or to throw litter against the strike board 114 and into the litter bin 96.

A motor mounting base 156 is attached to the outer side surface 126 of the first side bar 16 of the front carrier frame 4. A motor 158 is mounted to the motor mounting base 156. The motor 158 is approximately five horse power with a drive shaft 160 having a direction of rotation the same as the wheel mounted to the same side of the front carrier frame 4 as the motor 158. A shaft pulley 162 is attached to the drive shaft 160. The shaft pulley 162 is approximately four inches in diameter and aligned with the rod pulley 152 such that a V-belt 164 can connect the two pulleys 152 and 162 together. The V-belt 164 wraps loosely around the two pulleys 152 and 162. A clutch 166 is utilized to tighten the V-belt 164 around the pulleys 152 and 162 and thereby have the motor 158 drive the drive rod 134 and chains 147 to pick up litter.

The clutch 166 is comprised of a roller 168 connected between a first small metal plate 170 and a second small metal plate 172 with a weighted handle 174 connected to the first plate 170. The handle 174 pivots around a pin 176 that is connected to the outer side surface 122 of the first side bar 16 of the front carrier frame 4. Lifting the handle 174 lifts the roller 168 off the V-belt 164 and causes the V-belt 164 to loosen around the pulleys 152 and 162. Even with the motor 158 running, the rod 134 and chains 147 stop rotating. Once the handle 174 is released, the roller 168 makes contact with the V-belt 164 with the weight of the handle 174 forcing the roller 168 to tighten the V-belt 164 around the pulleys 152 and 162 thereby forcing the drive rod 134 and chains 147 to rotate.

In operation, the reel comprised of the drive shaft 134, disks 136, angle iron sections 142 and boards 144, having the chains 147 attached to two diametrically opposite angle iron sections 142, is rotated at a speed of about 150 RPM to 200 RPM with the outer one or two links of the chains coming in contact with the ground and any bottles, cans or other refuse that are in its path. The reel rotating at such speed generates sufficient centrifugal force to make the length of chain 147 project outwardly from their connection to their respective angle iron sections 142, and come into whipping and sweeping contact with the ground. Since the lengths of chain 147 are closely spaced apart, they come into contact with all of the refuse material on the ground that the operator desires to pick up. The whipping and sweeping action of the chains as they contact and sweep across the ground tends to dislodge cans and bottles that may be partially buried, and tosses them upwardly and rearwardly into the hopper 96.

The whole unit can be moved forwardly across the ground at an appropriate speed of three to four miles an hour, although the forward speed can be slower or faster. The forward speed is adjustable to whatever may be appropriate for the items of refuse being picked up and the quantity thereof.

When metal chains 147 are used, they can be coated with cushioning material such as a layer of polyvinyl chloride or the like to lesson the likelihood of breaking glass bottles when the pick up chains come in contact therewith.

Other material besides chains can be used as the pick up elements. The primary characteristics of whatever pick up elements are used are that they can dangle freely from the cross-bars, or angle iron sections 142, of the reel, that they are flexible in the sense of being limp and not returnable to an original shape after being flexed, and that they have a sufficient weight or mass to impart motion to objects they impact against as the reel is being rotated. Examples of other materials which may be used in this invention are a length of flexible metal mesh material, as well as heavy gauge metal or plastic screen material, connected along the length of the reel cross-bar, or angle iron sections 142.

Spaced apart length of rope made of fiber, or of cable made of metal and the like, may also be used in lieu of chains 147 depending on the type of refuse material that is to be picked up. For sweeping lawns, golf courses and the like of light weight refuse and debris such as twigs, leaves, paper and the like, pickup elements having less mass and weight than chains may be used such as length of rope or cable. To give such pick up elements greater whipping and impact force where desired, the outer free ends thereof may be knotted or weighted.

In any event, the invention is broad enough to include any kind of pick up element which has the characteristic of being able to dangle freely or limply from the cross bars of the reel when at rest, to extend outwardly therefrom by centrifugal force when the reel is rotated at a speed sufficient to generate such centrifugal force, and to have sufficient mass or weight to impart motion to items the pick up element impact against as the reel is being rotated.

Figure 7:
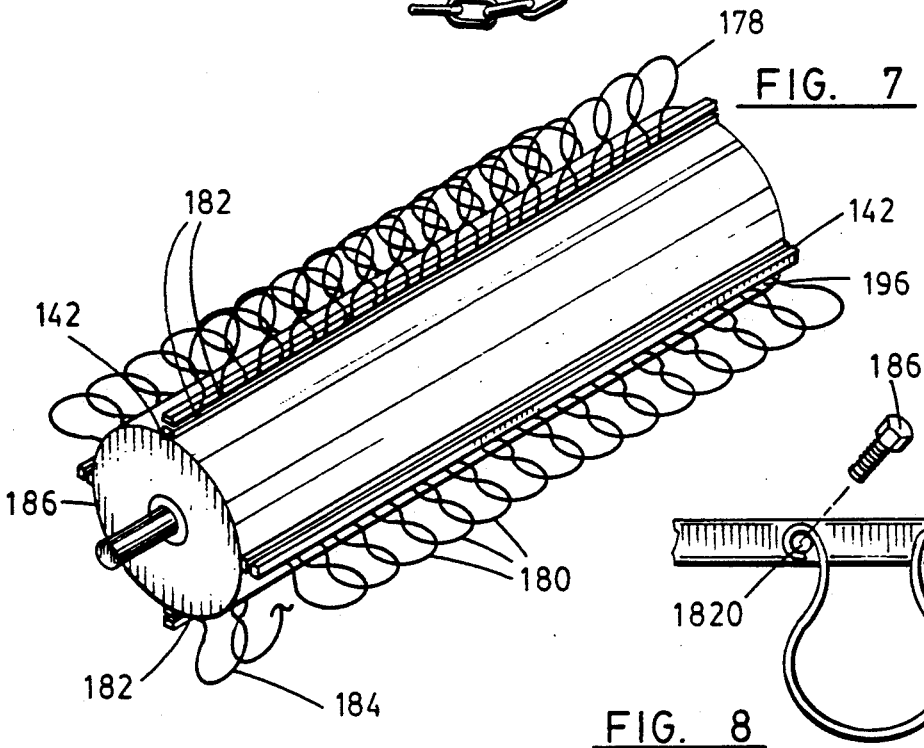
FIG. 7 is a perspective view of a modified reel and modified pick-up elements for use in the bottle and can, or refuse picker in accordance with this invention.
Figure 8:
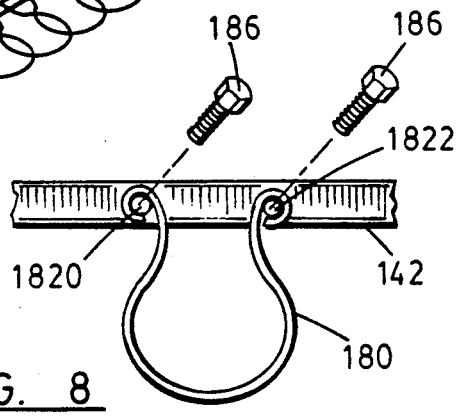
FIG. 8 is an elevation view of a length of flexible cable comprising the modified form of pick-up element shown in FIG. 7.
Figure 9:
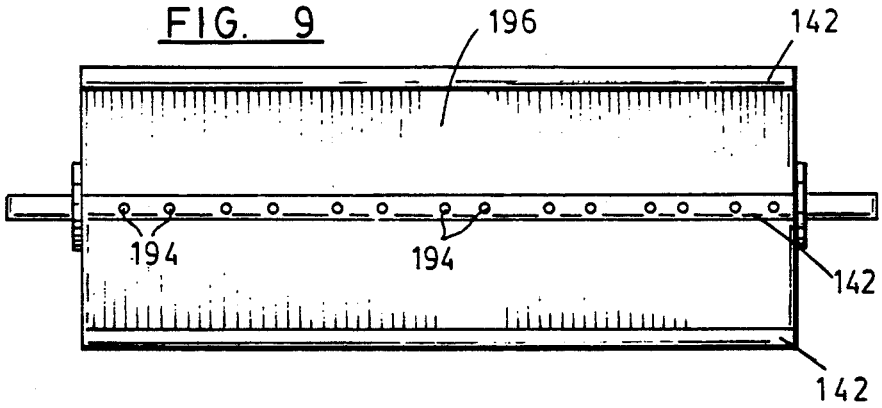
FIG. 9 is a front elevation view of a modified reel as shown in FIG. 7 with the pick-up elements removed, and illustrating the cross board to which respective clamp bars are connected to secure the pick-up elements to the cross bar.
Figure 10:
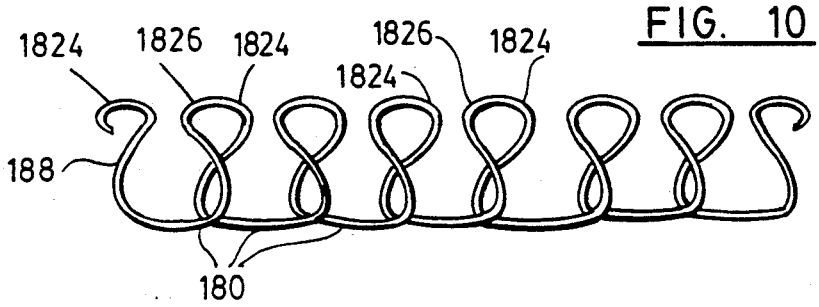
FIG. 10 is an elevation view of a single elongated length of flexible cable in which a plurality of loops are formed to comprise the modified pick-up elements of the type illustrated in FIG. 7.
Figure 11:
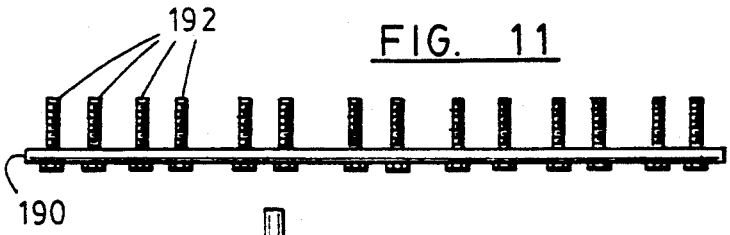
FIG. 11 is an elevation view of a clamp bar having threaded anchor bolts therein for securing to one of the cross bars of the reel shown in FIG. 9.
Figure 5:
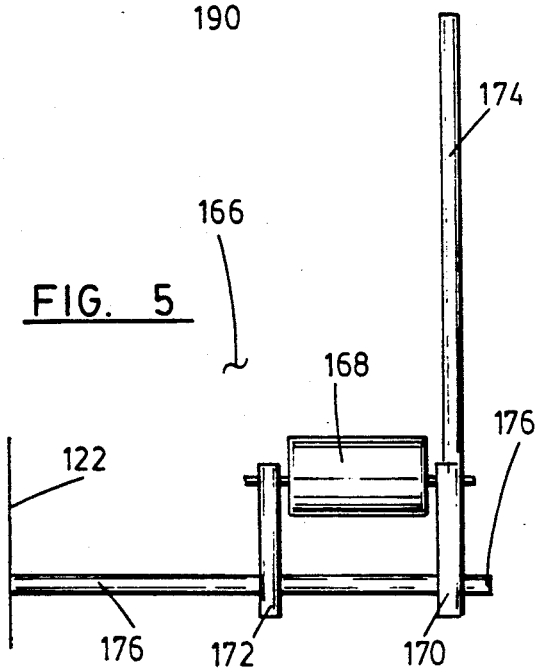
FIG. 5 is a front elevation view of the clutch assembly shown in FIG. 1 and FIG. 2.
Figure 6:
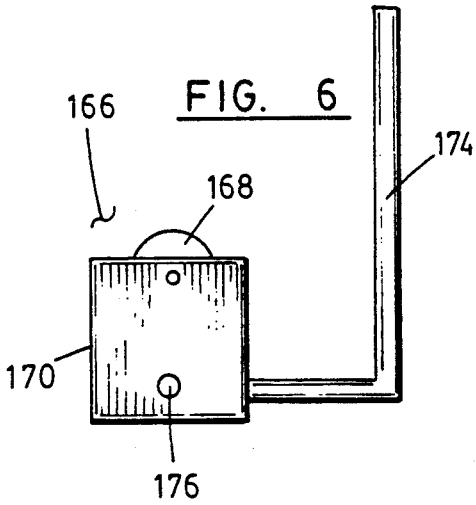
FIG. 6 is a side elevation view of the clutch assembly shown in FIG. 5.

Another specific kind of pick up element 178 for use in this invention is shown in FIG. 7. It comprises a plurality of loops 180 of flexible material such as a thin diameter steel cable encased in a cushioning resilient sheath such as vinyl or other plastic or polymeric material having the properties of resiliency to cushion the impact of such pick up elements when they come in contact with the bottles and other items of refuse which are to be picked up.

The loops 180 are secured at their connecting ends 182 to the angle irons or cross bars 142. The loops 180 extend across each cross bar 142 from one end to another.

The loops 180 extend from each cross bar 142 a distance sufficient to reach the ground when each cross bar 142 is rotated to its position closest to the ground plus a further distance that enables the looped end 184 of the loops 180 to flex toward a flat substantially horizontal position relative to the ground and extend forward of the cross bar 142 when the cross bar is in its position closest to the ground. Such construction of the loops 180 enable them to provide a sweeping motion across the ground as the reel 186 is rotated to bring each cross bar 142 and the looped ends 184 of the loops 180 connected thereto into contact with the ground. Each loop 180 encompasses whatever bottles, cans and other refuse are in its path whereby each loop and its closed loop end 184 provides a positive peripheral impact surface which extends around the side edge portions as well as the forward edge portions of the collection of bottles, cans and other refuse encompassed within the closed area of each loop 180.

Such positive peripheral impact action of each flexible loop 180 around the collection of refuse material caught up within its sweep, provides more effective pick up action while at the same time reducing the damage causing impact force of the pick up elements against the bottles, cans and other refuse items being picked up.

The loops 180 are closely spaced apart across each cross bar 142 whereby the looped end 184 of each adjacent loop 180 overlap each other.

Each loop 180 may by way of example extend from the cross bar 142 a distance of about one foot to a foot and a half. Each loop 180 may have a diameter, or span a distance between the sides of the loop, of about six inches to one foot at its widest portion. Each loop is preferably formed to have its widest portion adjacent its looped end 184.

The loops 180 may consist of individual lengths of flexible cable which terminate in two opposite connecting ends 1820 and 1822, each of which are then bolted or clamped to the cross bar 142, such as by threaded bolts 186.

As an alternative, the loops 180 may be formed from a single elongated cable 188 in which a plurality of loops 180 are formed in which their connecting ends 1824 and 1826 which connect each such loop 180 to a cross bar 142 do not terminate but are a continuous portion of the elongated cable 188, the connecting end 1826 of one loop becoming the connecting end 1824 of its next adjacent loop 180 on one side, and on the other side connecting end 1824 becomes the connecting end 1826 of the next adjacent loop on such other side.

A clamp bar 190 is provided to clamp the connecting ends 1824 and 1826 of the elongated cable 188 to each cross bar 142, and spaced apart threaded anchor bolts 192 extend from the clamp bar 190 to seat in and extend through corresponding apertures 194 in the cross bar 142 around which the connecting ends 1824 and 1826 of each loop 180 of the elongated cable 188 are anchored by extending around such threaded anchor bolts 192 and then compressing the clamp bar 190 against the cross bar 142 and the connecting end portions 1824 and 1826 of the loops 180 and elongated cable 188 which are sandwiches therebetween.

The reel 186 may include a solid cylindrical wall 196 to prevent refuse and debris from falling into the cylindrical space bounded by the circumference of said reel and possibly causing damage to the cross bars 142 and reel mechanism.

Figure 12:
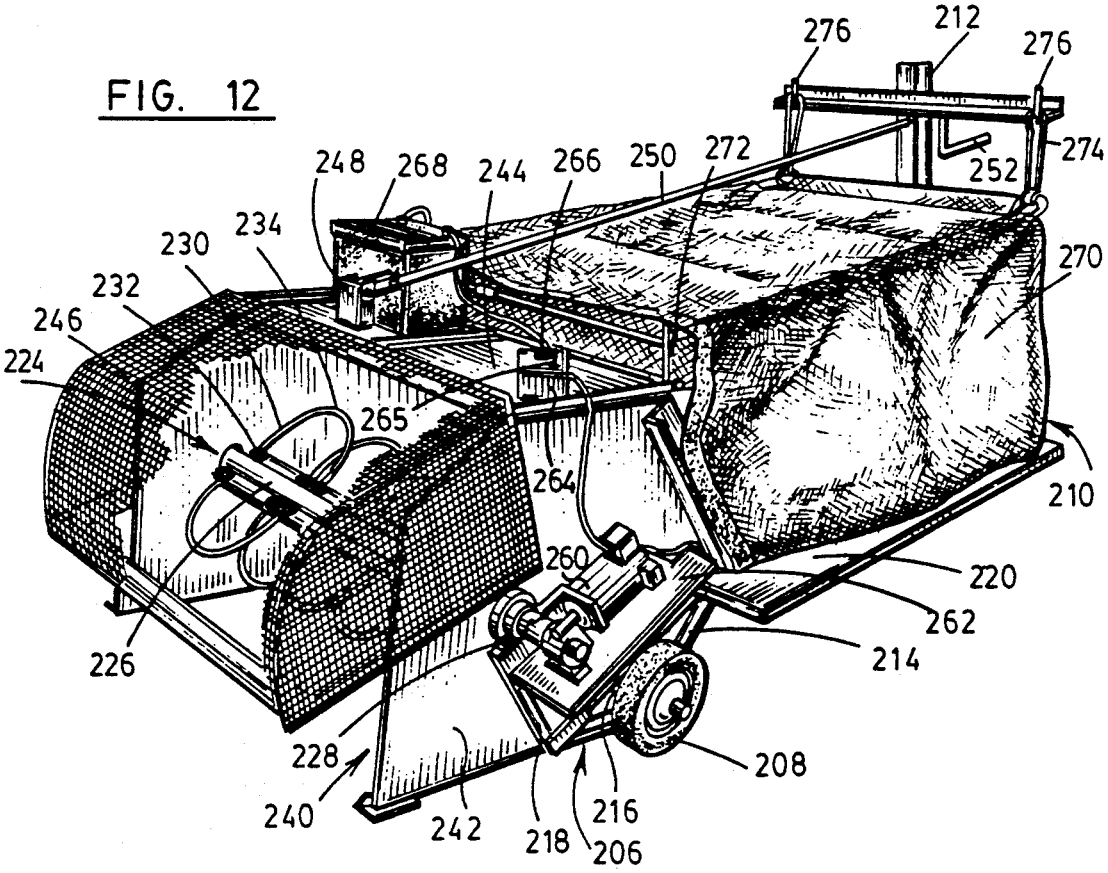
FIG. 12 is a perspective view of an alternative embodiment of the present invention.

Another embodiment of a bottle and can picker employing the loop elements as the pick-up elements is shown in FIG. 12. The bottle and can picker of this embodiment includes a carrier frame 204 supported at the front end thereof 206 by a pair of wheels 208. The carrier frame is supported at its rear end 210 by a third wheel (not shown) to help stabilize the frame during movement over the ground. A T-shaped handle bar 212 is mounted to the rear end 210 of the carrier frame so that the vertical portion of the T-shaped handle is perpendicular to the ground and the horizontal portion lies in a plane that is perpendicular to a central longitudinal axis extending from the front end 206 to the rear end 210 of the carrier frame.

The front end 206 of the carrier frame includes an angular base plate 214, to which the wheel axle 216 for the wheels 208 is mounted, and side members 218 that extend upwardly and forwardly from the sides of the angular base plate 214 forward of the wheels 208.

A base member 220 is disposed between the base plate 214 and the rear end 210 of the carrier frame. One end of the base member is rigidly secured to the rear end of the base plate, and the other end is rigidly secured to the rear end 210 of the carrier frame so that the base member is spaced above and generally parallel to the ground.

A rotatable member 224 comprises a shaft 226, journalled for rotation in suitable bearings 228 mounted on the side members 218, and a plurality of relatively flexible loop elements 230 mounted along the shaft 226 and extending radially outwardly therefrom. The loop elements are similar to those shown and described in connection with FIGS. 7–11. For example, the loop elements 230 are similarly made of flexible material such as a thin diameter steel cable encased in a cushioning resilient sheath such as vinyl or other plastic or polymeric material to cushion the impact of the loop elements 230 when they come in contact with the bottles and other items of refuse which are to be picked up.

The loops 230 are secured at their connecting ends 232 to the rotatable member 224 and are mounted side by side on the rotatable member so that each loop 230 overlaps the next adjacent loop. Each loop element 230 has a central longitudinal axis that extends between its connecting ends 232 and its looped end 234. The loop elements are mounted on the rotatable member 224 so that the central longitudinal axes of the loop elements extend radially toward the rotatable member. It has been found that two sets of loop elements 230 circumferentially spaced 180° apart along the rotatable member 224, as shown in FIG. 12, are satisfactory for picking up bottles, drink cans and other refuse. However, additional sets of loop elements circumferentially spaced apart about the rotatable member may be employed.

The rotatable member 224 and the loop elements 230 are contained within a hood 240 mounted to the base plate 214. The hood 240 includes side panels 242, secured to the side members 218 by means of bolts or the like, a top plate 244, similarly secured to the side panels 242, and a wire mesh cover portion 246 secured to the top plate 244. The cover portion 246 extends forward of the side panels 242 and overlies the rotatable member, with the bottom portion of the cover being open to the ground.

The hood 240 also includes an upwardly and rearwardly extending deflector plate (not shown) mounted at its opposite ends to the side panels 242. The deflector plate overlies the base plate 214 and is angled so that its forward most edge is adjacent the ground and its rearward most edge is above the base member 220.

The hood 240, together with the rotatable member 224 and the loop elements 230, may be raised or lowered relative to the ground by means of a hinge 248 mounted to the top plate 244. The hinge 248 is connected to a crank shaft 250, which extends to the rear end 210 of the carrier frame, through an opening in the vertical portion of the T-shaped handle 212, and terminates in a crank handle 252 Turning the crank handle changes the relative position of the hinge 248 which, in turn, allows the position of the hood 240 and the rotatable member 224 and the loop elements 230 to be set closer to or further from the ground upon which the litter is being collected.

A motor 260 is rigidly secured to a mounting plate 262 by means of bolts or the like. The mounting plate, in turn, is rigidly secured to the side member 218 and the side panel 242. The motor 260 is preferably a 12 volt electric motor and drives the rotation of the rotatable member 224 at an average speed of about 100 rpms. The motor is operatively connected to a control box 264 which includes an on-off switch 265 and a variable speed control 266. The variable speed control controls the speed of rotation of the rotatable member, which may range from about 50 rpms to 150 rpms. Generally, a slower speed of about 50 rpms is suitable for lighter-weight trash items, such as paper or styrofoam cups, while a faster speed of about 100–150 rpms is required for heavier items, such as bottles and cans. The control box 264 is connected to a 12 volt battery 268. Both the control box 264 and the battery 268 are mounted to the top plate 244 by means of bolts or the like.

Positioned immediately rearwardly of the deflector plate is a sack-like container 270, for receiving the bottles and cans picked up and thrown rearwardly by the loop elements 230. The container 270 is preferably made of canvas or other strong material and is held in an open position by a rigid upper frame member 272. A pair of ropes 274 are mounted on the rear end of the frame member 272 and are detachably looped over vertical hooks 276 mounted on the horizontal bar of the handle 212 to hold the rear of the container 270 in place. The front end of the frame member 272 is detachably bolted to the top plate 244 to hold the container 270 in position immediately rearwardly of the deflector plate.

In operation, the rotatable member 224 and the loop elements 230 are adjusted relative to the ground by turning the crank handle 252. The rotatable member 224 is adjusted so that the looped ends 234 of the loop elements 230 contact the ground and flex slightly toward the direction of rotation when the connecting ends 232 are in a position closest to the ground. The rotatable member 224 is rotated counter clockwise with respect to FIG. 12, causing the loop elements 230 to come in sweeping contact with the ground. As the loop elements 230 contact bottles, cans and other debris on the ground, they dislodge the debris and sweep it upwardly and rearwardly over the deflector plate and into the container 270.

Figure 13:
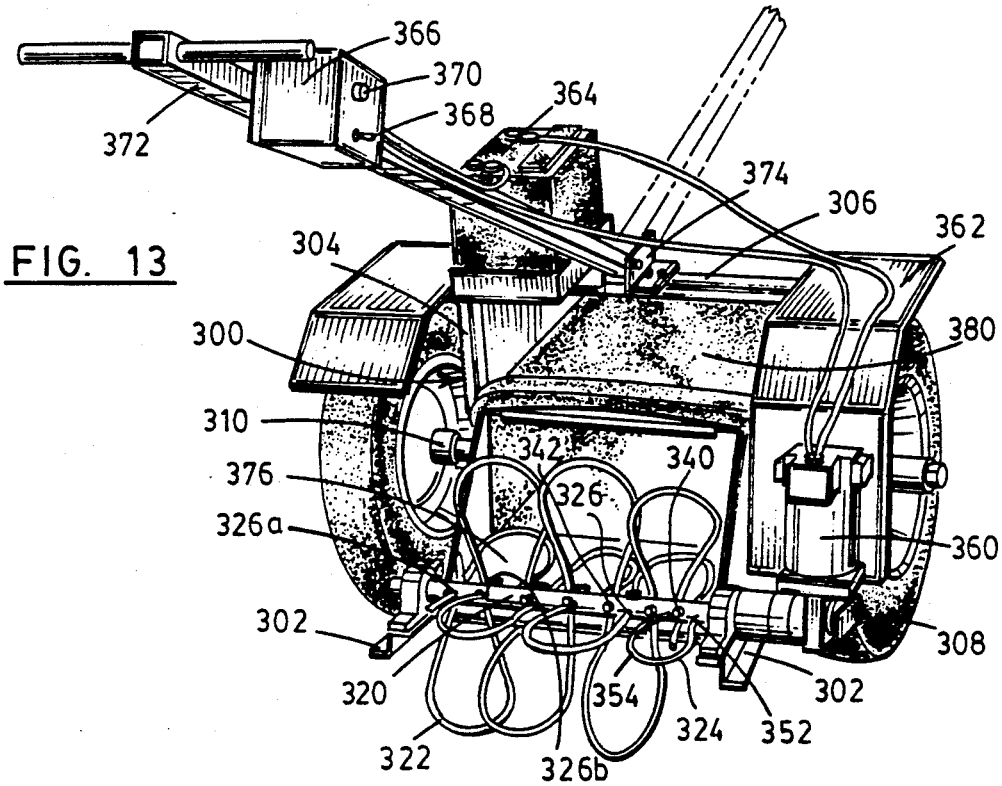
FIG. 13 is a perspective view of another embodiment of the present invention showing an alternative method of forming and securing the loop pick-up elements to the rotatable member.

Another embodiment of the bottle and can picker of the present invention is illustrated in FIG. 13. This embodiment includes an open, generally square shaped carrier frame 300 comprising bottom rails 302, side rails 304 (only one of which is illustrated) and a top rail 306. The carrier frame is supported for movement over the ground by wheels 308 journalled on shafts 310 which are secured to the side rails 304.

A rotatable shaft 320 is journalled for rotation in suitable bearings 321 mounted on the bottom rails 302. A plurality of loop elements 322 are mounted along the shaft 320 and extend radially outward therefrom. The loop elements 322 are formed by threading one or more elongated flexible cables 324 back and forth through apertures 326 spaced along the length of the rotatable shaft 320. The cable 324 is threaded in one direction through a first aperture **326*a* and the looped end threaded in the opposite direction through a second aperture 326*b*. The cable 324 is threaded in this back and forth manner along the length of the rotatable shaft 320 to form two rows of loop elements spaced circumferentially 180° apart. In FIG. 13**, two such cables are threaded back and forth to form four sets of loop elements, with each set being spaced 90° apart from the next about the rotatable shaft.

The loop elements are secured in place on the rotatable shaft by fastening means, such as set screws 340 that are screwed into apertures 342 at 90° from each cable insertion. Each screw is screwed into the aperture 342 until it contacts and tightens upon the cable within the rotatable shaft 320.

The loop elements 322 are formed so that each loop has two connecting ends 352 and a looped end 354, and has a central longitudinal axis that extends between its connecting ends 352 and its looped end 354. The central longitudinal axes extend radially toward the rotatable shaft 320 and intersect it, preferably at right angles. The length of the loop elements is adjustable by releasing the pressure of the set screws 340 upon the cable 324 and manually lengthening or shortening the loops to the desired working position, and then tightening the screws upon the cable. The working position refers to the position of the loops relative to the ground and depends upon the nature of the terrain from which the bottles, cans and other debris are to be removed. If the terrain is fairly even, the length of the loops 322 is preferably adjusted so that the length is slightly longer than the distance between the rotating shaft 320 and the ground, so that the looped end 354 flexes slightly rearwardly, toward the direction of rotation of the rotating shaft 320. This position enable the loops to get underneath and lift up the bottles, cans and other debris from the ground. If the terrain is uneven, with dips and depressions, it is preferable to have the length of the loops longer than for even terrain, to permit the loops 322 to contact and lift up refuse located in the dips and depressions.

An electric motor 360 is rigidly secured to a fender 362 over one of the wheels 308. The motor 360 is in operative engagement with the rotatable shaft 320 for driving the rotation of the shaft at an average speed of about 100 rpms. The motor 360 is connected to a rechargeable battery 364, mounted to the top rail 306, which provides the energy necessary for the motor 360. The battery 364 is operatively connected to a control box 366 mounted to a handle bar 372. The control box 366 includes an on-off switch 368 and a variable speed control 370, for varying the speed of rotation of the rotatable shaft 320 between 50 and 150 rpms, depending upon the type of refuse to be picked up by the loops.

The handle bar 372 is mounted to the top rail 306 so that it extends at an acute angle relative to the ground. To facilitate maneuverability, the handle bar is adjustable between a forward facing and a rearward facing direction, and is used for manually pulling the bottle and can picker when in the forward facing position and for pushing it when in the rearward facing position. Adjustment of the handle bar position is accomplished by a removable hinge pin 374, positioned adjacent the base of the handle bar 372. The hinge pin 374 is removed to adjust the handle and then replaced after adjustment to lock the handle in place.

Immediately behind and in the direction of rotation of the rotatable shaft 320 is a deflector plate 376. The deflector plate 376 is secured at its sides to the inner sides of an open waste receptacle 380 and is angled upwardly and rearwardly so that the front end of the deflector plate is adjacent the ground and the rear end of the deflector plate is inside the waste receptacle 380. The deflector plate serves to guide and direct the refuse into the waste receptacle 380.

The waste receptacle 380 is removably attached at its sides to the side rails 304. The attachment mechanism (not shown) may be, for example, a pin inserted through apertures in the waste receptacle and the side rails 304 and secured in place by a wing nut. The side rails 304 may be provided with a series of apertures (not shown) positioned one above the next so that the height of the waste receptacle 380 can be adjusted relative to the ground by inserting the pin through a higher or lower aperture in the side rail 304.

While preferred embodiments have been shown, modifications and changes may become apparent to those skilled in the art which shall fall within the spirit and scope of the invention. It is intended that such modifications and changes be covered by the attached claims.

What is claimed is:

1. An improved assembly for picking up bottles, drink cans and other refuse discarded on the ground that may include undulating terrain comprising an elongated rotatable member having first and second ends and a central longitudinal axis about which the rotatable member may rotate and which is spaced above and generally parallel to the ground; a carrier frame; means for mounting the first and second ends of the rotatable member on the carrier frame so that the rotatable member will rotate about its central longitudinal axis; means for supporting the carrier frame for movement over the ground; means for rotating said rotatable member on the carrier frame and about its central longitudinal axis; a plurality of sets of flexible loops, with each set of loops including a plurality of loops that are mounted, side by side, along the rotatable member between its first and second ends, and with the sets of loops being spaced, one set from another, circumferentially about the periphery of the rotatable member; with each loop in each set of loops having:

a looped end and two connecting ends that are connected, at a predetermined connection point, with the rotatable member for rotation therewith about the longitudinal central axis of the rotational member;

a central longitudinal axis that extends between its looped end and its connecting ends and that is generally perpendicular to the central longitudinal axis of the rotatable member; and a length, along its longitudinal axis between its looped end and its connecting ends, that is greater than the distance between its point of connection and the ground when the point of connection is closest to the ground and when a set of said loops is in contact with the ground, so that the loops will serve to pick up bottles, drink cans and other refuse as the assembly moves over the ground.

2. An improved assembly as set forth in claim 1 wherein the looped end of a loop overlaps the looped end of its adjacent loop in each set of loops.

3. An improved assembly as set forth in claim 1 wherein the central longitudinal axis of each loop in each set of loops extends generally radially toward the central longitudinal axis of the rotatable member and intersects the central longitudinal axis of the rotatable member at right angles.

4. An improved assembly as set forth in claim 1 wherein the improved assembly comprises in addition means for adjustably positioning the rotatable member above the surface of the ground at various working refuse-pickup positions; and wherein the central longitudinal axis of each loop in each set of loops extends generally radially toward the central longitudinal axis of the rotatable member and intersects the central longitudinal axis of the rotatable member at right angles when the rotatable member is adjusted to a rotational position which brings the looped end of the loop closest to the surface of the ground and when the rotatable member is adjusted to a position where the distance between the connection points of the loop to the rotatable member and the surface of the ground is greater than the length of the loop along its central longitudinal axis; and wherein each loop in each set of loops has a length, along its longitudinal axis between its looped end and its connecting ends, that is greater than the distance between its points of connection to the rotatable member and the ground when the points of connection are closest to the ground and when the rotatable member is adjusted to a working refuse-pickup position relative to the surface of the ground.

5. An improved assembly as set forth in claim 1, wherein the assembly includes a protective hood mounted to the carrier frame over and around the rotatable member.

6. An improved assembly as set forth in claim 5, wherein said assembly includes means for positioning the rotatable member above the surface of the ground at a working refuse pick-up position, and said means for positioning includes a hinge mechanism operatively associated with the protective hood and the rotatable member.

7. An improved assembly as set forth in claim 1, wherein the assembly includes a removable waste receptacle supported by the carrier frame and positioned immediately rearwardly of the rotatable member for receiving the bottles, drink cans and other refuse picked up by the loop elements.

8. An improved assembly as set forth in claim 1, wherein the rotatable member is a rotating shaft and the loops are formed by threading at least one length of flexible cable back and forth through apertures in the rotating shaft to form two sets of loops spaced 180 degrees apart about the rotating shaft.

9. An improved assembly as set forth in claim 8 wherein the assembly includes means for adjusting the length of each loop relative to the ground at various working refuse pick-up positions.

10. An improved assembly as set forth in claim 8, wherein the assembly includes a second length of flexible cable threaded back and forth through apertures in the rotating shaft forming two sets of loops spaced 180 degrees apart so that the rotating shaft has four sets of loops each spaced 90 degrees apart from the next.

11. An improved assembly as set forth in claim 1, wherein said assembly includes means for positioning the rotatable member above the surface of the ground at a working refuse pick-up position.

12. An improved assembly for picking up bottles, drink cans and other refuse discarded on the ground that may include undulating terrain comprising: a rotatable member, a carrier frame having said rotatable member mounted for rotation thereon, said carrier frame including support means for supporting the frame for movement over the ground, rotating means for rotating said rotatable member in one direction of rotation, said rotatable member including lateral connecting means extending laterally of said direction of rotation, refuse pick up means extending outwardly from said lateral connecting means, said refuse pick up means comprising a plurality of loop members each comprising a loop portion and an open refuse receiving area encompassed by and within said loop portion, each of said loop members being formed by a length of cable having a portion thereof connected to said lateral connecting means of said rotatable member and a portion extending therefrom to form said loop portion and said open refuse receiving area encompassed by and within said loop portion.

13. An improved assembly as set forth in claim 12, wherein each of said loops extends outwardly from said lateral connecting means a pre-determined length and terminates at a looped end, said refuse picking assembly includes positioning means to position said rotatable member above the surface of the ground at a working refuse pick up position, said pre-determined length by which each of said loops extend outwardly from said lateral connecting means being a sufficient length for said looped end of said flexible cable to flex toward a flat substantially horizontal position relative to the ground and to extend forward of said lateral connecting means as it is rotated to reach its position closest to the ground at such time as said rotatable member is positioned above the surface of the ground at said working refuse pick up position.

14. An improved assembly as set forth in claim 13, wherein said positioning means includes a height adjustment mechanism operatively associated with said carrier frame, said height adjustment mechanism having a lower end portion thereof in contact with the surface of the ground, a vertically movable portion upwardly and downwardly relative to said lower end portion and thereby position said rotatable member at a selected pre-determined distance above the surface of the ground.

15. An improved assembly as set forth in claim 13, wherein said support means includes a wheel assembly, and said carrier frame having said rotatable member carried thereon is pivotally connected to said wheel assembly to enable said carrier frame and said rotatable member to follow the contour of the surface of the ground and keep said rotatable member at substantially said working refuse pick up position as said refuse picking assembly is propelled along the ground and as said contour rises and falls.

16. An improved assembly as set forth in claim 12, wherein said length of flexible cable which form each of said loops comprises a plurality of metal strands, and a flexible sheath of resilient material encasing said metal strands.

17. An improved assembly for picking up bottles, drink cans and other refuse discarded on the ground that may include undulating terrain comprising: a rotatable member having first and second ends and a central longitudinal axis about which the rotatable member rotates and which is spaced above and generally parallel to the ground; a reel having first and second ends, a periphery, and a central longitudinal axis which is coaxial with the central longitudinal axis of the rotatable member; means for connecting the reel with the rotatable member so that the reel may rotate with the rotatable member about their central longitudinal axes; a carrier frame; means for mounting the first and second ends of the rotatable member on the carrier frame so that the rotatable member and the reel will rotate about their central longitudinal axes; means for supporting the carrier frame for movement over the ground; means for rotating said rotatable member and the reel on the carrier frame and about their central longitudinal axes; means for picking up refuse on the ground comprising a plurality of sets of flexible loops, with each set of loops including a plurality of loops that are mounted, side by side, along the reel between its first and second ends, and with the sets of loops being spaced, one set from another, circumferentially about the periphery of the reel, with each loop in each set of loops having:

a looped end and two connecting ends that are connected, at a predetermined connection point, with the reel for rotation therewith about its longitudinal axis;

a central longitudinal axis that extends between its looped end and its connecting ends and that is generally perpendicular to the central longitudinal axis of the reel; and a length, along its longitudinal axis between its looped end and its connecting ends, that is greater than the distance between its point of connection and the ground when the point of connection is closest to the ground and when a set of said loops is in contact with the ground so that the loops will pick up bottles, drink cans and other refuse as the assembly moves over the ground.

18. An improved assembly according to claim 17 wherein a plurality of cross bars are circumferentially spaced apart about the periphery of said reel; and said connecting ends of said loops of each set of loops are secured to one of said cross bars.

19. An improved assembly according to claim 18, wherein said plurality of cross bars includes at least a first cross bar and a circumferentially spaced apart second cross bar, one of the sets of loops of said refuse pick up means includes a first elongated length of flexible cable affixed to said first cross bar of said reel and shaped to form a plurality of continuously joined loops, and another of the sets of loops including a second elongated length of flexible cable affixed to said second cross bar of said reel and shaped to form a plurality of continuously joined loops.

20. A refuse picking assembly as set forth in claim 19 including a first releasable clamp member to clamp said first elongated length of flexible cable having said loops formed therein to said first cross bar of said reel, a second releasable clamp member to clamp said second elongated length of flexible cable having said loops formed therein to said second cross bar of said reel.

21. A refuse picking assembly as set forth in claim 19, wherein said reel includes a solid cylindrical wall, said first cross bar on said reel being arcuately spaced apart from said second cross bar on said reel one-hundred and eighty degrees.

22. A refuse picking assembly as set forth in claim 21, wherein said plurality of cross bars on said reel include a third cross bar arcuately spaced apart ninety degrees from said first and second cross bars, and a fourth cross bar diametrically opposite from said third cross bar, said refuse pick up means includes a third elongated length of flexible cable being affixed to said third cross bar of said reel and shaped to form a plurality of continuously joined loops, and a fourth elongated length of flexible cable being affixed to said fourth cross bar of said reel and shaped to form a plurality of continuously joined loops, loops shaped from said third and fourth elongated length of cable comprising a loop portion and an open refuse receiving area encompassed by and within said loop portion.

23. An improved assembly as set forth in claim 17 where there is an overlap between the loop portions of adjacent, side by side loops in each set of loops.

24. An improved assembly as set forth in claim 17 wherein the improved assembly comprises in addition means for adjustable positioning the rotatable member and the reel above the surface of the ground at various working refuse-pickup positions; and wherein the central longitudinal axis of each loop in each set of loops extends generally radially toward the central longitudinal axis of the reel and intersects the central longitudinal axis of the reel at right angles when the rotatable member and the reel are adjusted to a rotational position which brings the looped end of the loop closest to the surface of the ground and when the rotatable member and the reel are adjusted to a position where the distance between the connection points of the loop to the reel and the surface of the ground is greater than the length of the loop along its central longitudinal axis; and wherein each loop in each set of loops has a length, along its longitudinal axis between its looped end and its connecting ends, that is greater than the distance between its points of connection to the reel and the ground when the points of connection are closest to the ground and when the rotatable member and the reel are adjusted to a working refuse-pickup position relative to the surface of the ground.

* * * * *